United States Patent [19]

Martz et al.

[11] 4,142,236

[45] Feb. 27, 1979

[54] ELECTRONIC SCORECARD FOR GOLF

[76] Inventors: Kenneth L. Martz, 1532 Canadian Trail, Plano, Tex. 75023; Roger L. Nations, Rte. 2, Anna, Tex. 75003

[21] Appl. No.: 890,408

[22] Filed: Mar. 27, 1978

Related U.S. Application Data

[63] Continuation-in-part of Ser. No. 787,617, Apr. 14, 1977, abandoned.

[51] Int. Cl.[2] ..... G06F 15/44; A63B 57/00

[52] U.S. Cl. ..... 364/411; 273/162 A

[58] Field of Search ..... 364/411, 900 MS File; 235/92 GA; 273/162 A, 32 R

[56] References Cited

U.S. PATENT DOCUMENTS

| | | | |
|---|---|---|---|
| 2,211,635 | 8/1940 | Barteaux | 273/162 A X |
| 3,665,494 | 5/1972 | Baumoel | 364/410 |
| 3,847,110 | 11/1974 | Inoue | 273/32 R X |
| 3,974,483 | 10/1976 | Brunson | 235/92 GA X |
| 3,999,050 | 12/1976 | Pitroda | 364/419 |
| 4,041,291 | 8/1977 | Pavda | 364/705 |

*Primary Examiner*—David H. Malzahn

*Attorney, Agent, or Firm*—Richards, Harris & Medlock

[57] ABSTRACT

An electronic scorecard for golf includes a keyboard having keys or switches representative of the digits 0–9 and commands. A preprogrammed microprocessor is responsive to manipulation of the keyboard to store in memory golf course data and player scoring data for multiple players. Appropriate manipulation of the keyboard commands the microprocessor to perform arithmetic operations on certain of said data. A display connected to the microprocessor visually presents the desired data or results individual to each player for comparison during the game.

15 Claims, 6 Drawing Figures

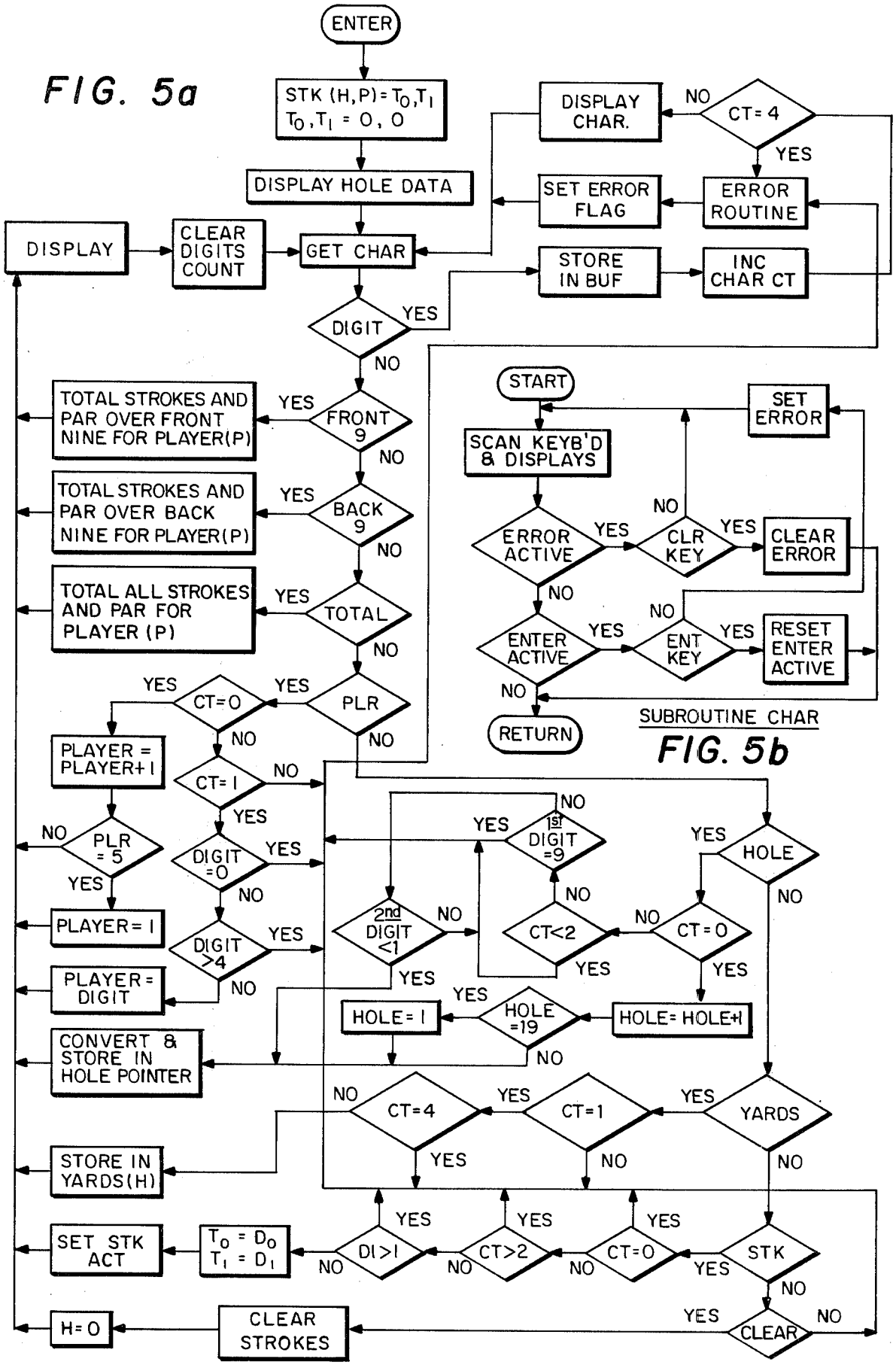
FIG. 5a
ENTER
STK (H,P) = T0,T1
T0,T1 = 0, 0
DISPLAY HOLE DATA
DISPLAY
CLEAR DIGITS COUNT
GET CHAR
DIGIT
YES
NO
DISPLAY CHAR.
CT=4
SET ERROR FLAG
ERROR ROUTINE
STORE IN BUF
INC CHAR CT
TOTAL STROKES AND PAR OVER FRONT NINE FOR PLAYER(P)
FRONT 9
TOTAL STROKES AND PAR OVER BACK NINE FOR PLAYER(P)
BACK 9
TOTAL ALL STROKES AND PAR FOR PLAYER (P)
TOTAL
PLR
CT=0
PLAYER = PLAYER+1
CT=1
PLR = 5
PLAYER=1
DIGIT =0
DIGIT >4
PLAYER = DIGIT
CONVERT & STORE IN HOLE POINTER
STORE IN YARDS(H)
SET STK ACT
T0 = D0
T1 = D1
DI>1
CT>2
CT=0
STK
CLEAR
CLEAR STROKES
H=0
START
SET ERROR
SCAN KEYB'D & DISPLAYS
ERROR ACTIVE
CLR KEY
CLEAR ERROR
ENTER ACTIVE
ENT KEY
RESET ENTER ACTIVE
RETURN
SUBROUTINE CHAR
FIG. 5b
1st DIGIT =9
HOLE
2nd DIGIT <1
CT<2
CT=0
HOLE=1
HOLE =19
HOLE= HOLE+1
CT=4
CT=1
YARDS

ELECTRONIC SCORECARD FOR GOLF

CROSS-REFERENCE TO RELATED APPLICATION

This application is a continuation-in-part of application Ser. No. 787,617, filed Apr. 14, 1977, now abandoned.

BACKGROUND AND SUMMARY OF THE INVENTION

The present invention relates generally to a device for keeping score during a game of golf. More particularly, this invention concerns a handheld electronic scorecard for receiving, storing and displaying golf course and player scoring information.

The game of golf has become extremely popular in the United States as well as in other countries. The game is played outdoors on a golf course with golf balls and a set of different types of golf clubs. The standard golf course consists of eighteen units of play, commonly referred to as holes. Each hole is assigned a numerical value known as par, which represents the number of strokes required by an expert to play the ball from the tee into the hole on the green. The par value for each hole is determined by the distance between the tee and the green together with any obstacles or hazards which may be located therebetween. Consequently the par value is an indicator of the difficulty of the hole. The par value for the course is simply the cumulative par values of the holes. The player score is simply the cumulative stroke values required to play the holes. The objective of the game is to skillfully play the ball into each hole with the fewest number of strokes.

Scoring during a game is commonly kept on a hole by hole basis. At the present this is mostly done manually by writing on a paper scorecard the number of strokes required at the completion of each hole. If desired for comparison purposes, the subtotals of the par and stroke values can be figured at the same time. These subtotals, of course, must be refigured after each hole. It will thus be apparent that this continual score keeping and figuring can be a considerable distraction and nuisance not only to each golfer, but also to the other golfers with whom he or she is playing. Although present electronic devices could be employed, the results are unsatisfactory. Heretofore such prior art devices have been incapable of maintaining scoring and course data for multiple players over the lengthy time period required for a game. There is thus a need for a portable scoring device for quickly and conveniently manipulating such data.

The present invention comprises an electronic scorecard for golf which overcomes the foregoing problems and other difficulties associated with the prior art. In accordance with the broader aspects of the invention, the yardage and par values for each hole of the golf course are entered by appropriate manipulation of a keyboard and electronically stored. During play, the stroke value for each hole individual to each player is also entered by manipulation of the keyboard and electronically stored. This data is available for processing and display at any time during play. The information for a particular hole, or the accumulated par and stroke values after play of the desired number of holes can be selectively displayed for reference purposes by any one of the players. Use of the invention eliminates the distracting and time consuming operations typical of the prior art approaches to score keeping.

According to more specific aspects of the invention, a handheld electronic scorecard for golf comprises input means, processing means, memory means and output means. The scorecard has two modes of operation. In the program mode, the yardage and par values for each hole of the golf course are entered by means of a keyboard included in the input means. A preprogrammed microprocessor takes this data and stores it in a memory for subsequent retrieval and use. The memory is continuously powered so that data storage is maintained for at least the duration of the game. In the play mode, the stroke values for each hole of the golf course individual to each one of a multiplicity of players are similarly entered and stored for subsequent retrieval and use. By appropriate manipulation of the keyboard, the data for a preselected hole, or the accumulated par and stroke values after play of several holes, individual to each player can be selectively displayed for visual comparison by the player on a digital display included in the output means.

DESCRIPTION OF THE DRAWINGS

A more complete understanding of the invention can be had by reference to the following Detailed Description when taken in conjunction with the accompanying Drawings, wherein:

FIGS. 5*a* and 5*b* are detailed flow charts of the program employed in the invention.

DETAILED DESCRIPTION

Figure 1:
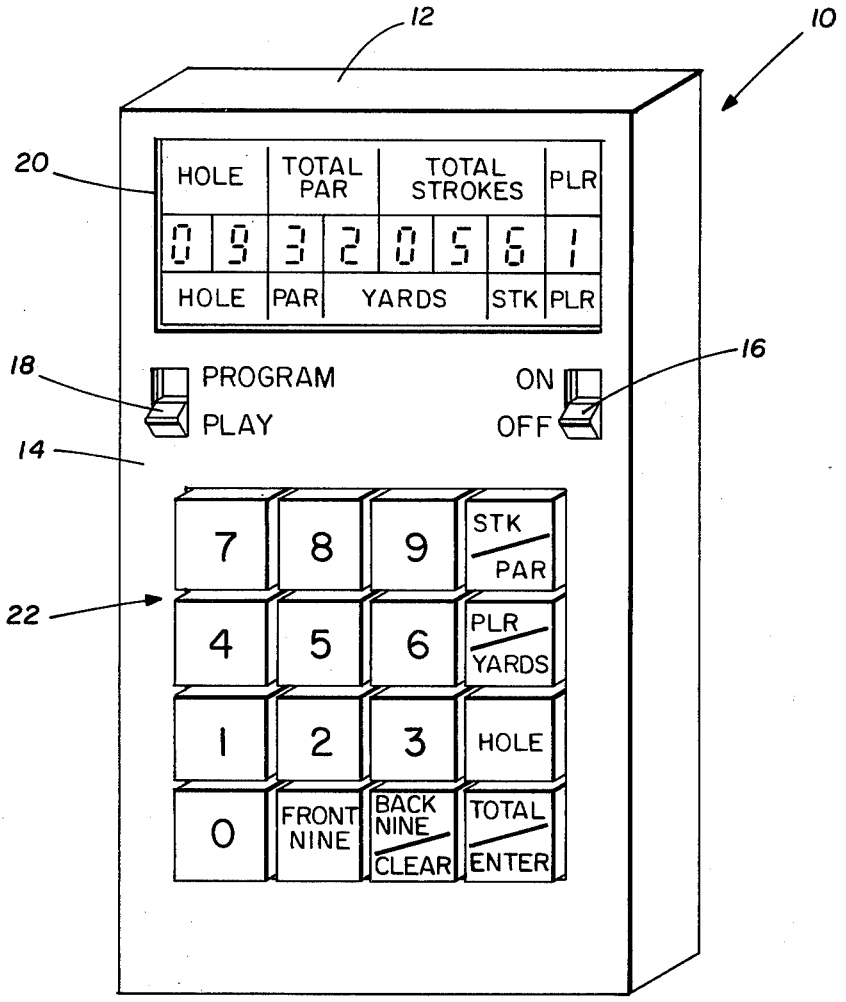
FIG. 1 is a front perspective view of an electronic scorecard for golf incorporating the invention.

Referring now to the Drawings, wherein like reference characters designate like or corresponding parts throughout the several views, and particularly referring to FIG. 1, there is shown an electronic scorecard for golf 10 incorporating the invention. The scorecard 10 includes a casing 12 of generally shallow, box-like configuration. The casing 12 can be constructed of any suitable material, such as high impact plastic. The casing 12 is of compact overall dimensions so that the scorecard 10 can be easily carried by any golfer. As will be described more fully hereinafter, all of the components comprising the scorecard 10 are contained in or on the casing 12.

The controls for operating the scorecard 10 are found on the front panel 14 of casing 12. The panel 14 includes switches 16 and 18. The switch 16 comprises a power switch having ON and OFF positions. The switch 18 comprises a mode select switch having PROGRAM and PLAY positions. A digital display 20 is provided near the top of panel 14. The display 20 is preferably of the type characterized by low power consumption and high visibility under daylight conditions. Legends are imprinted on the panel 14 above and below the display 20 for correlation of the information displayed. For example, the digits shown on the display 20 in FIG. 1 could represent that player number one required six strokes to play hole number nine, which has a par value of three and a yardage value of 205. Alternatively, the same readout on the display 20 could represent that player number one required 56 strokes against the total par value of 32 to play the first nine holes of the golf course. It will thus be apparent that the display 20 comprises the output means for visually presenting certain golf course and player information.

A keyboard 22 is also provided on panel 14 for selectively entering certain information into the scorecard 10. The keyboard 22 is comprised of 16 push-style or touch button keys or switches. The keys representative of the numerals 0–9, plus the keys labeled HOLE and FRONT NINE are single function keys. The remainder of the keys in the keyboard 22 are dual function keys whose purpose depends upon the position of the mode switch 18. For example, the PLR/YARDS key is utilized to enter the yardage value in the program mode, but is utilized to enter the player number in the play mode. Likewise, the STK/PAR key is employed to enter par values in the program mode, but functions to enter stroke values in the play mode. The other dual function keys of the keyboard 22 operate similarly. It will thus be appreciated that the keyboard 22 functions as the input means for entering golf course and player information into the scorecard 10, as well as for initiating predetermined operations thereby.

Figure 2:
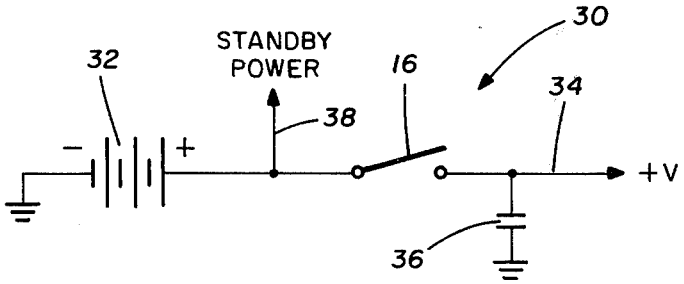
FIG. 2 is a schematic diagram of the power supply utilized in the invention.
Figure 3:
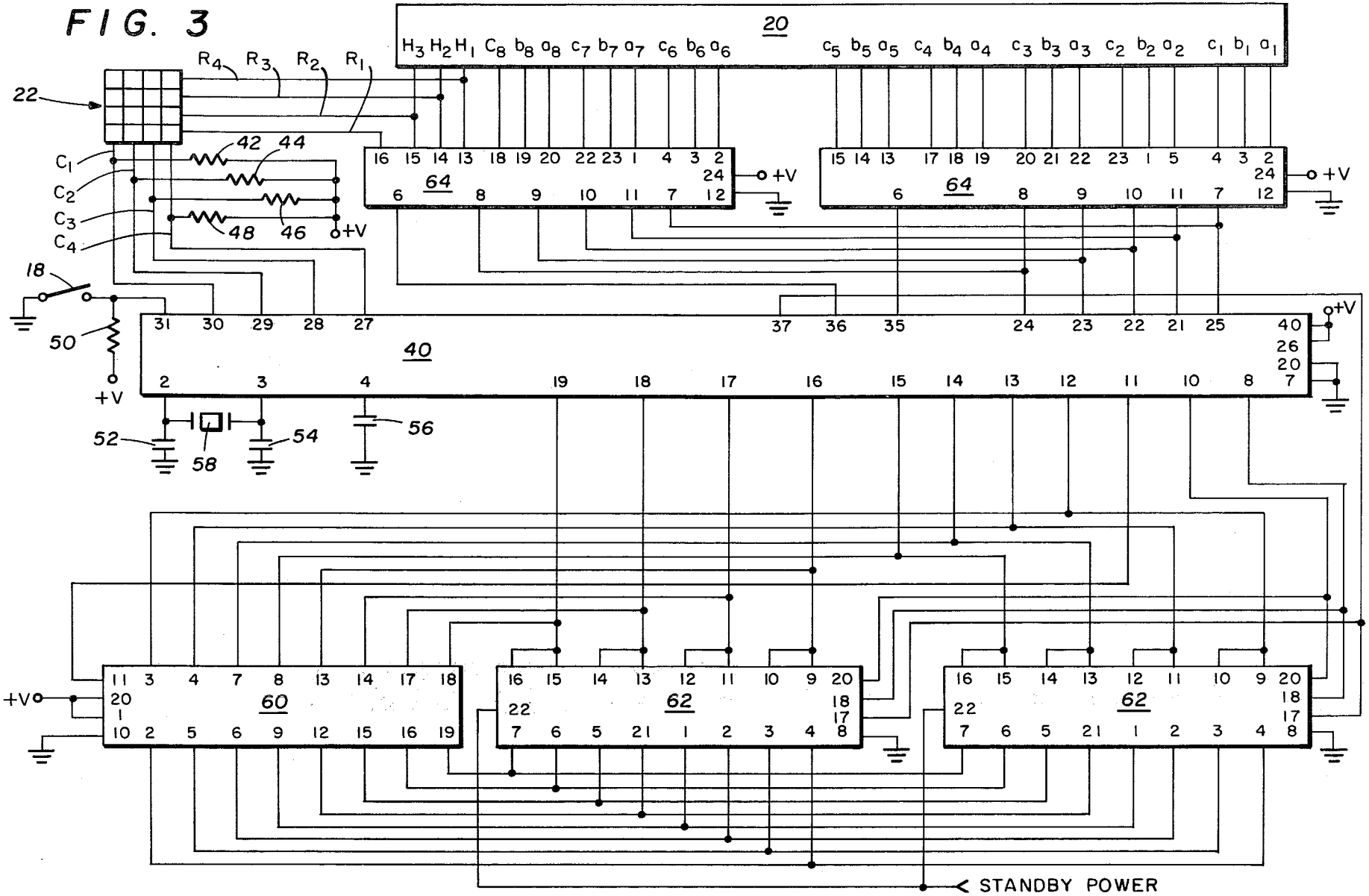
FIG. 3 is a schematic diagram of the circuitry utilized in the invention.

Referring now to FIGS. 2 and 3, there is shown the circuitry employed in the scorecard 10. In particular, FIG. 2 illustrates the power supply 30 for energizing the various components of the scorecard 10 shown in FIG. 3. The power supply 30 includes a battery 32 connected between ground potential and one terminal of power switch 16. A rechargeable nickel cadmium type battery generating approximately 5 volts DC can be utilized for battery 32. The power switch 16, which is located on the front panel 14, is a normally open single pole/single throw (SPST) switch. When the switch 16 is closed, current flow indicated as +V is established through line 34. It will be understood that power supply line 34 is connected wherever +V appears in the wiring diagram of FIG. 3. A bypass capacitor 36 is provided between the line 34 and ground potential to bypass electronic noise produced by components in scorecard 10. A line 38 is connected to the battery 32 in front of the switch 16 and is thus independent of the position of switch 16. It will be understood that line 38 is connected wherever the designation STANDBY POWER appears on the wiring schematic of FIG. 3. Line 38 is utilized to maintain power to preselected components within the scorecard 10 without regard to operation of switch 16. It will thus be apparent that line 38 can only be deenergized by removal of the battery 32.

The various components energized by the power supply 30 are shown in FIG. 3. The keyboard 22 is connected to the display 20 and a microprocessor 40. As discussed hereinbefore, the keyboard 22 is comprised of sixteen keys representative of the numerals 0–9 and certain commands. Any suitable keyboard characterized by low power consumption can be utilized for the keyboard 22. In the preferred embodiment of the invention, keyboard 22 comprises a conventional 4 × 4 matrix type keyboard having eight connections thereto. Lines R1, R2, R3 and R4 comprise the input connections for keyboard 22. Lines C1, C2, C3 and C4 comprise the output connections for the keyboard 22. The output lines C1, C2, C3 and C4 of keyboard 22 are connected through resistors 42, 44, 46 and 48 to +V of the power supply 30, and are maintained in a logic high level thereby. Depressing a predetermined key on the keyboard 22 closes a circuit between a preselected pair of input and output lines so that a unique combination of logic levels is produced by lines C1–C4 and R1–R4. A binary representation corresponding to depression of a preselected key on the keyboard 22 is thus effected.

The output terminals of the keyboard 22 are connected to the input terminals of the microprocessor 40. The microprocessor 40 is a single chip, self contained unit having its own central processing unit, read only memory (ROM), random access memory (RAM) and appropriate input/output controls. As will be described more fully hereinafter, the ROM portion of the microprocessor 40 is preprogrammed to perform various operations responsive to manipulation of the keyboard 22.

Any of several commercially available microprocessors characterized by low power consumption and sufficient RAM and ROM capacities can be utilized for the microprocessor 40. An example of a suitable microprocessor is the Model 8049 manufactured by the Intel Corporation of Santa Clara, Calif. In accordance with the preferred construction, which employs the Model 8049 microprocessor, lines C1, C2, C3 and C4 of keyboard 22 are connected to pins 30, 29, 28 and 27, respectively, of the microprocessor 40. The other pins of microprocessor 40 which are utilized are connected as follows. Pin 31 of the microprocessor 40 is connected through a resistor 50 to +V of the power supply 30. The pin 31 is also connected to ground potential through the single pole/single throw (SPST) program switch 18. When the program switch 18 is open, which corresponds to the PLAY mode, the pin 31 is in a logic high condition. Pin 31 of microprocessor 40 goes to a logic low condition when switch 18 is closed, which corresponds to the PROGRAM mode. The state of pin 31 is read by the ROM to sense the operational mode for microprocessor 40. Pins 26 and 40 of the microprocessor 40 are also connected to +V of the power supply 30. Pins 7 and 20 of the microprocessor 40 are connected to ground potential. Pins 2, 3 and 4 are connected through capacitors 52, 54 and 56, respectively, to ground potential. Pin 4 and capacitor 56 initialize microprocessor 40 on startup. A crystal 58 is coupled between the pins 2 and 3 as part of the oscillator for generating the clock signals utilized by the microprocessor 40.

The microprocessor 40 is connected to a latch 60 and memories 62 for information storage and retrieval. Any of several commercially available eight bit latches characterized by low power consumption can be used for the latch 60. For example, the Model 74LS273 latch manufactured by Texas Instruments of Dallas, Tex. has been found suitable. Pin 11 of the microprocessor 40 is connected to pin 11 of the latch 60 for carrying the address latch enable signal. The pins 1 and 20 of latch 60 are connected to +V of the power supply 30, while pin 10 thereof is connected to ground potential. The input pins 3, 4, 7, 8, 13, 14, 17 and 18 of the latch 60 are connected to the input/output (I/O) bidirectional pins 12–19, respectively, of the microprocessor 40.

The bidirectional pins 12–15, respectively, of the microprocessor 40 are also connected to input pin pairs 9 and 10, 11 and 12, 13 and 14, and 15 and 16, respectively, of one memory 62. The bidirectional pins 16–19, respectively, of microprocessor 40 are likewise connected to the same pairs of pins on the other memory 62. The memories 62 are each four bit random access memories (RAMS) characterized by low power consumption. For example, a Model 5101L RAM manufactured by the Intel Corporation of Santa Clara, Calif. can be used for each of the memories 62. Pins 20 of the memories 62 are connected to the pin 10 of the microprocessor 40 for receiving a write signal therefrom. The pin 18 of each memory 62 is connected to the pin 8 of the microprocessor 40 for receiving a read signal therefrom. Pins 17 of memories 62 are connected to the pin 37 of the microprocessor 40 for receiving a chip select signal therefrom. Pin 8 of each memory 62 is connected to ground potential, while standby power from the power supply 30 is applied to pins 22 of memories 62. Finally, the address input pins 7, 6, 5, 21, 1, 2, 3 and 4, respectively, of each memory 62 are connected to the output pins 19, 16, 15, 12, 9, 6, 5 and 2, respectively, of the latch 60.

The remaining pins of the microprocessor 40 are connected through expanders 64 to the digital display 20. Each expander 64 comprises an input/output port expander and data latch for driving the display 20 and keyboard 22 logic level inputs. The Model 8243 data expander/latch manufactured by the Intel Corporation of Santa Clara, Calif. is an example of a device suitable for use as each expander 64. Pin 6 of each expander 64 is individually connected to either pin 35 or pin 36 of the microprocessor 40 for receiving chip select signals therefrom. Pins 7 of the expanders 64 are connected to pin 25 of the microprocessor 40 for receiving other command signals. The data input pins 8, 9, 10 and 11 of the expanders 64 are coupled to the pins 24, 23, 22 and 21, respectively, of the microprocessor 40 for data transfer therebetween. The pin 12 of each expander 64 is connected to ground potential, while the pin 24 is connected to +V of the power supply 30.

Figure 4:
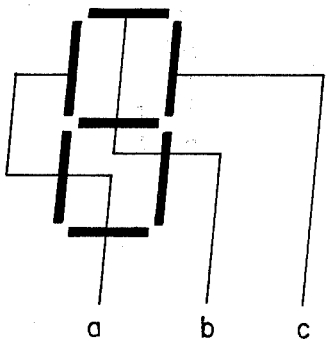
FIG. 4 is a diagram illustrating one typical connection to the display.

With further reference to FIG. 3 in conjunction with FIG. 4, the outputs of expanders 64 are coupled to the digital display 20. In accordance with the preferred construction, an eight place digital display, such as the Model 8105 liquid crystal display manufactured by the Sharp Corporation, can be employed as the display 20. Each digit of the display 20 comprises a conventional seven segment arrangement having a trio of connections thereto, as shown in FIG. 4. Display 20 is multiplexed so that the proper segments are illuminated to form the desired digit. One expander 64 drives five of the digital places in display 20, with the remaining places being driven by the other expander. The pins *a*1, *b*1 and *c*1 of the display 20 are connected to the pins 2, 3 and 4, respectively, of the right expander 64. The pins *a*2, *b*2 and *c*2 of display 20 are connected to the pins 5, 1 and 23, respectively, of the right expander. The pins *a*3, *b*3 and *c*3 of display 20 are connected to the pins 22, 21 and 20, respectively, of the right expander 64. The pins *a*4, *b*4 and *c*4 of display 20 are connected to the pins 19, 18 and 17, respectively, of the right expander 64. The pins *a*5, *b*5 and *c*5 of display 20 are connected to the pins 13, 14 and 15, respectively, of the right expander 64. The pins of the left expander 64 are connected as shown in FIG. 3 to the display 20 beginning with pins *a*6, *b*6 and *c*6. Finally, the pins H1, H2 and H3 of display 20 are connected to the input pins R4, R3 and R2, respectively, of the keyboard 22 as well as to pins 13, 14 and 15 of the left expander 64. The input pin R1 of keyboard 22 is connected to pin 16 of the left expander 64 only.

OPERATION OF THE INVENTION

With reference to FIGS. 5*a* and 5*b*, which contain a detailed flow chart of the program stored in the ROM of microprocessor 40, the operation of the scorecard 10 will now be set forth. FIGS. 5*a* and 5*b* illustrate the programming logic employed when keeping score for no more than four players. This is for purposes of example only. It will be appreciated that the same basic program with appropriate changes can be utilized for more than four players, depending upon the RAM and ROM sizes of scorecard 10.

Before beginning play, the yardage and par values for each hole of the golf course must first be stored in the scorecard 10. To do so, the switch 16 is placed in the ON position, and mode switch 18 is placed in the PROGRAM position. The keyboard 22 is then manipulated to enter the desired information. The numerical key or keys corresponding to the number of the hole are first actuated, followed by depression of the HOLE key. The numerical key corresponding to the par value of the hole is then actuated, followed by depression of the PAR key. The numerical keys corresponding to the yardage value of the hole are next actuated, followed by depression of the YARDS key. These key operations are carried out for each hole so that the golf course information is stored in memories 62. Each value appears on the display 20 as it is keyed into the scorecard 10 so that the user can identify any keyboard errors.

While the mode switch 18 is in the PROGRAM position, old stroke values for each hole can be removed from memory before commencing play. This is accomplished simply by depression of the CLEAR key. According to the preferred operation of the invention, the ROM of the microprocessor 40 is programmed in this mode to erase only player stroke values and no other information. It will be understood, however, that complete disconnection or removal of the battery 32 effects erasure of all information from the scorecard 10 regardless of the position of mode switch 18.

Placement of the mode switch 18 in the PLAY position prepares the scorecard 10 for receipt of player information and other operations. Each player utilizing the scorecard 10 is assigned a player identification number. The stroke value individual to each player for each hole can be entered either on a hole by hole basis, or a stroke by stroke basis. This is accomplished by depressing the numerical key or keys corresponding to the player number followed by actuation of the PLR key. The numerical key or keys corresponding to the particular hole number are then depressed followed by actuation of the HOLE key. The numerical key corresponding to the stroke value is next depressed, followed by actuation of the STK key and then the ENTER key. These key operations store the stroke values by hole for each player. As this player information is keyed into the scorecard 10, it appears on the display 20 so that the user can check for keyboard errors.

The information for a particular hole and player can be the recalled and displayed. This is accomplished by depressing the numerical key or keys corresponding to the player number, followed by depressing the PLR key, and by actuating the numerical keys representative of the hole number followed by actuating the HOLE key. Preferably, scorecard 10 is programmed so that actuation of the PLR key alone causes display of that hole's information for the next higher player, or the first player if the preceding player was the last. Actuation of the HOLE key alone causes display of hole information for the next hole for the same player. Thus, actuation of either the PLR or HOLE keys by themselves automatically index scorecard 10 to the next player or hole, respectively.

The total par and stroke values through holes played and up to nine holes of play can be figured and shown on the display 20 by actuating the numerical key or keys representative of the player number, next depressing the PLR key and then depressing the FRONT NINE key. The total par and stroke values through holes played for between holes ten and eighteen can be figured and shown on the display 20 by actuating the numerical key or keys representative of the player number, next depressing the PLR key and then depressing the BACK NINE key. The total par and stroke values after play of any desired number of holes beginning with hole one can be figured and shown on the display 20 by first depressing the numerical key or keys representative of the player number, next actuating the PLR key and then depressing the TOTAL key.

When the scorecard 10 is not being used for information entry on retrieval, the switch 16 is placed in the OFF position. The battery 32 is thus disconnected from all components except for memories 62 so that power is conserved while information storage is maintained.

In view of the foregoing, it will be apparent that the present invention comprises an electronic scorecard for golf which incorporates numerous advantages over the prior art. Golf course and player information for multiple players are maintained electronically in a portable unit of convenient, handheld size. One significant advantage of the invention is the fact that this information is available for display at any time during play. The information for a particular hole, or the accumulated par and stroke values after play of the desired number of holes can be figured and displayed for any one of the players. Other advantages derived from the use of the invention will readily suggest themselves to those skilled in the art.

Although preferred embodiments of the invention have been illustrated in the accompanying Drawings and described in the foregoing Detailed Description, it will be understood that the invention is not limited to the embodiments disclosed, but is intended to embrace any alternatives, modifications, and rearrangements or substitutions of parts or elements as fall within the spirit and scope of the invention.

What is claimed is:

1. An electronic scorecard for the game of golf, which comprises:

input means having switches representative of digits for selectively inputting numerical golf course data and player scoring data for at least one player;

said input means including switches representative of predetermined commands;

processing and memory means responsive to the input means for receiving the golf course and player scoring data, and for performing predetermined arithmetic operations on said data; and output means responsive to the processing and memory means for visually presenting the selected golf course and player scoring data to the player.

2. The electronic scorecard of claim 1, wherein the numerical golf course and player scoring data inputted comprises yardage, par and player stroke values for each hole of the golf course.

3. The electronic scorecard of claim 1, wherein one of the switches in said input means represents a command to retrieve and display the par, yardage and player stroke values for a predetermined hole of the golf course.

4. The electronic scorecard of claim 1, wherein certain of the switches in said input means represent commands to arithmetically sum the par and player stroke values for play through a predetermined number of holes.

5. The electronic scorecard according to claim 4, wherein one of said switches represents a command to total said values over the first nine holes of play.

6. The electronic scorecard according to claim 4, wherein one of said switches represents a command to total said values over the second nine holes of play.

7. The electronic scorecard according to claim 4, wherein one of said switches represents a command to total said values beginning with the first hole and ending with the last hole played for up to eighteen holes.

8. The electronic scorecard of claim 1 wherein the output means comprises a liquid crystal type digital display.

9. For the game of golf, a portable electronic scorecard with a self-contained, internal power supply, which comprises:

input means including a plurality of manually operable keys for entering yardage and par values individual to each hole of the golf course, stroke values individual to each one of a plurality of players for each hole of the golf course, and for initiating manipulations on said values by the scorecard;

preprogrammed processing means responsive to operation of said input means for controlling manipulation, including arithmetic operations, of the values received from said input means;

memory means coupled to the processing means for storing said values and the results of the arithmetic operations performed by said processing means on said values;

output means responsive to the processing means for visually presenting the values stored in said memory means; and switch means for selectively disconnecting the power supply from said input means, processing means and output means to conserve power, said memory means being constantly connected to said power supply for maintenance of data storage during the game.

10. The electronic scorecard of claim 9 wherein one of the keys of the input means represents a command to display for a predetermined hole the yardage and par values together with the stroke value required by a preselected player for said hole.

11. The electronic scorecard of claim 9 wherein one of the keys of the input means represents a command to arithmetically sum both the stroke values required for a predetermined player and the par values for each hole up to the last hole played between the first and ninth holes inclusive.

12. The electronic scorecard of claim 9 wherein one of the keys of the input means represents a command to arithmetically sum both the stroke values required for a predetermined player and the par values for each hole up to the last hole played between the 10th and 18th holes inclusive.

13. The electronic scorecard of claim 9 wherein one of the keys of the input means represents a command to arithmetically sum both the stroke values required by a preselected player and the par values for each hole up to and including the last hole played beginning with the first hole.

14. The electronic scorecard of claim 9 wherein certain of said keys are dual function keys, and further including mode switch means coupled to the processing means for changing the response of said processing means to operation of said dual function keys in accordance with the position of said mode switch.

15. For the game of golf, a portable electronic scorecard having a self-contained, internal power supply, which comprises:

keyboard input means including keys for entering numerical values corresponding to the yardage and par values for each hole of the golf course and the stroke values individual to each one of a plurality of players for each of said holes;

said input means further including keys for initiating arithmetic operations on said numerical values, including the summation of said par and player stroke values for play over a predetermined number of holes;

preprogrammed processing means responsive to actuation of the keys of said input means for storing said yardage, par and stroke values and for performing said summation operations on said values;

memory means coupled to the processing means for storing said values and the results of the summations performed by said processing means;

digital output means coupled to the processing means for visually displaying the values stored in the memory means; and switch means for selectively disconnecting the power supply from the keyboard input means, processing means and the digital output means to conserve power, said memory means being constantly coupled to said power supply for maintenance of the values stored therein.

* * * * *